US010218153B2

(12) United States Patent
Inoue et al.

(10) Patent No.: US 10,218,153 B2
(45) Date of Patent: Feb. 26, 2019

(54) SPARK PLUG

(71) Applicant: NGK Spark Plug Co., LTD., Nagoya (JP)

(72) Inventors: Masahiro Inoue, Gifu (JP); Takahiro Karumi, Komaki (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/415,085

(22) Filed: Jan. 25, 2017

(65) Prior Publication Data

US 2017/0214220 A1 Jul. 27, 2017

(30) Foreign Application Priority Data

Jan. 26, 2016 (JP) ..... 2016-011983

(51) Int. Cl.
*H01T 13/32* (2006.01)

(52) U.S. Cl.
CPC ..... *H01T 13/32* (2013.01)

(58) Field of Classification Search
CPC ..... H01T 13/32
See application file for complete search history.

(56) References Cited

U.S. PATENT DOCUMENTS

2001/0015602 A1* 8/2001 Hori ..... H01T 21/06 313/141
2005/0029915 A1* 2/2005 Yorita ..... H01T 13/39 313/141
2009/0127997 A1 5/2009 Kameda et al.
2009/0134764 A1 5/2009 Kameda et al.
2009/0140624 A1 6/2009 Kameda et al.
2010/0264803 A1 10/2010 Nunome et al.
2010/0264804 A1 10/2010 Kameda et al.
2010/0275870 A1 11/2010 Kameda et al.
2010/0283373 A1 11/2010 Kamada
(Continued)

FOREIGN PATENT DOCUMENTS

JP 60-136489 U 9/1985
JP 2001-307857 A 11/2001
(Continued)

OTHER PUBLICATIONS

Extended European Search Report dated Jun. 20, 2017 for the corresponding European Patent Application No. 17152462.2.
(Continued)

*Primary Examiner* — Kevin Quarterman
(74) *Attorney, Agent, or Firm* — Leason Ellis LLP

(57) ABSTRACT

A spark plug includes an insulator; a center electrode; a metal shell; and a ground electrode whose base end is fixed to the metal shell. A distal end of the ground electrode includes a first surface facing the center electrode, a second surface facing a side opposite to the first surface, and an inclined surface that is inclined with respect to the second surface. A noble metal tip is partially buried in the inclined surface. A width of the inclined surface is larger than that of the noble metal tip. In this spark plug, A B is satisfied, where A is a distance from a distal end of the ground electrode to a proximal-end-side end portion of the inclined surface and B is a distance from the distal end of the ground electrode to a proximal-end-side end portion of the noble metal tip.

10 Claims, 6 Drawing Sheets

(56) References Cited

U.S. PATENT DOCUMENTS

| | | | |
|---|---|---|---|
| 2011/0210659 | A1 | 9/2011 | Suzuki et al. |
| 2014/0333195 | A1 | 11/2014 | Nishikawa |
| 2015/0022074 | A1 | 1/2015 | Inoue et al. |

FOREIGN PATENT DOCUMENTS

| | | | |
|---|---|---|---|
| JP | 2009-295569 | A | 12/2009 |
| JP | 2013-191560 | A | 9/2013 |
| JP | 2014-220143 | A | 11/2014 |
| JP | 2015-22791 | A | 2/2015 |
| WO | WO-2010/053116 | A | 5/2010 |

OTHER PUBLICATIONS

Office Action dated Nov. 21, 2017 for the corresponding Japanese Patent Application No. 2016-011983.

* cited by examiner

| E [mm] | θ [°] | | | | | |
|---|---|---|---|---|---|---|
| | 0 | 2 | 4 | 6 | 8 | 10 |
| 0.1 | FAIL | FAIL | FAIL | FAIL | FAIL | FAIL |
| 0.2 | PASS | PASS | PASS | PASS | FAIL | FAIL |
| 0.3 | PASS | PASS | PASS | PASS | FAIL | FAIL |
| 0.4 | PASS | PASS | PASS | PASS | PASS | FAIL |

SPARK PLUG

This application claims the benefit of Japanese Patent Application No. 2016-011983, filed Jan. 26, 2016, which is incorporated herein in its entirety by reference.

BACKGROUND OF THE INVENTION

1. Field of the Invention

The present invention relates to a spark plug.

2. Description of the Related Art

In order to increase the durability of a spark plug, hitherto, a noble metal tip has been joined to a ground electrode of the spark plug. For example, as with a spark plug described in Japanese Unexamined Patent Application Publication No. 2015-22791, if the noble metal tip protrudes from an end of the ground electrode, a sparking location can be concentrated at the end of the ground electrode, so that it is possible to increase the durability and ignitability.

However, in recent years, in order to increase fuel economy performance, the fuel has been made leaner and supercharging has been performed in an internal combustion engine. Therefore, the spark plug is required to provide even higher ignitability to allow reliable ignition even when the spark plug is used in such an internal combustion engine.

SUMMARY OF THE INVENTION

The present invention has been made to realize the aforementioned object, and can be realized in the following forms.

An aspect of the present invention provides a spark plug. The spark plug includes an insulator having an axial hole along an axial line; a center electrode that is provided in the axial hole; a cylindrical metal shell that is disposed around an outer periphery of the insulator; and a ground electrode whose base end is fixed to the metal shell. The ground electrode includes a distal end portion comprising; a first surface that faces a side of the center electrode, a second surface that faces a side that is opposite to the first surface, and an inclined surface that is formed continuously with a distal end of the first surface and is inclined with respect to the second surface such that a thickness of the ground electrode decreases towards a distal end side of the ground electrode. A noble metal tip is joined to the inclined surface such that part of the noble metal tip is buried in the inclined surface. A width of the inclined surface is larger than a width of the noble metal tip. In the spark plug, $A \geq B$ is satisfied, where A is a distance from a distal end of the ground electrode to a proximal-end-side end portion of the inclined surface and B is a distance from the distal end of the ground electrode to a proximal-end-side end portion of the noble metal tip. According to the spark plug according to such an aspect, since the ground electrode has the inclined surface, the hampering of the growth of a flame kernel produced by a discharge between the center electrode and the noble metal tip (flame quenching) can be suppressed. Therefore, it is possible to increase the ignitability.

In the spark plug according to the above-described aspect, the inclined surface may be a planar surface, and an inclination angle $\theta$ of the inclined surface with respect to the second surface may be greater than or equal to 1 degree. According to the spark plug of such a form, it is possible to increase the ignitability.

In the spark plug according to the above-described aspect, the inclined surface may be a planar surface; an inclination angle $\theta$ of the inclined surface with respect to the second surface may be less than or equal to 6 degrees; and a burying amount E of the noble metal tip along the axial line from the proximal-end-side end portion of the inclined surface may be greater than or equal to 0.2 mm. According to the spark plug of such a form, since the falling off of the noble metal tip is suppressed, it is possible to increase the durability.

In the spark plug according to the above-described aspect, an external shape of the inclined surface may be a rectangular shape, and $(A \times D)/S \leq 4$ is satisfied, where D is the width of the inclined surface and S is an area of the inclined surface excluding the noble metal tip and a welded portion formed by the ground electrode and the noble metal tip. According to the spark plug of such a form, since the area of the inclined portion can be properly provided, flame quenching is further suppressed, so that it is possible to further increase the ignitability.

In the spark plug according to the above-described aspect, $A \geq C$ is satisfied, where C is a distance from the distal end of the ground electrode to a proximal-end-side end portion of a welded portion formed by the ground electrode and the noble metal tip. According to the spark plug of such a form, it is possible to further increase the ignitability.

The present invention may be realized in various forms other than in the form of the above-described spark plug. For example, the present invention may be realized as a method of producing the spark plug.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

First Embodiment

Figure 1:
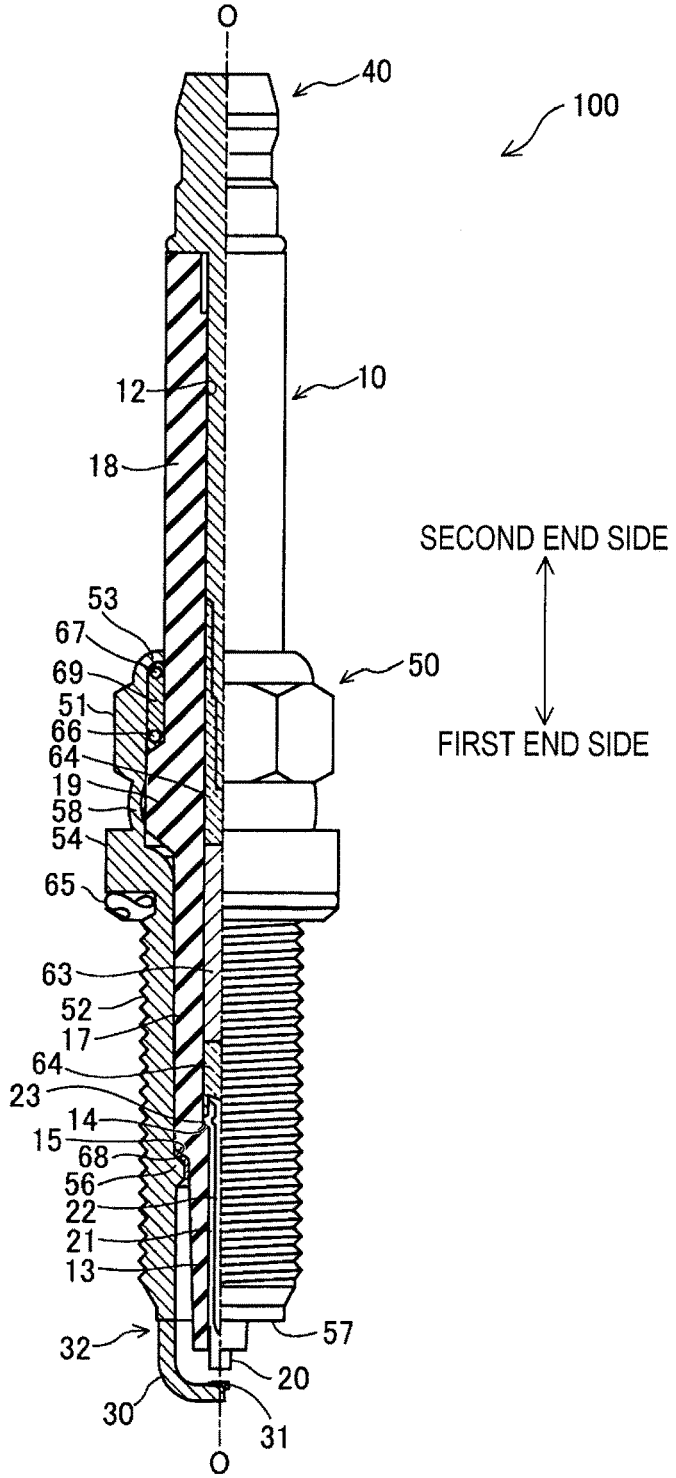
FIG. 1 is a partial sectional view of a spark plug.

FIG. 1 is a partial sectional view of a spark plug 100 according to a first embodiment of the present invention. The spark plug 100 has an elongated shape along an axial line O. In FIG. 1, the right side of the axial line O indicated by an alternate long and short dash line corresponds to an external front view, and the left side of the axial line O corresponds to a sectional view in which the axial line passes. In the description below, the lower side of FIG. 1 is called a "first end side" of the spark plug 100, and the upper side of FIG. 1 is called a "second end side".

The spark plug 100 includes an insulator 10 having an axial hole 12 along the axial line O, a center electrode 20 that is provided in the axial hole 12, a cylindrical metal shell 50 that is disposed around an outer periphery of the insulator 10, and a ground electrode 30 whose base end is fixed to the metal shell 50.

The insulator 10 is made of insulating glass formed by sintering a ceramic material including alumina. The insulator 10 is a cylindrical member having the axial hole 12 in the center thereof, a first end side of the axial hole 12 accommodating part of the center electrode 20 and a second end side accommodating part of a metal terminal 40. A center body portion 19 having a large outside diameter is provided at the center of the insulator 10 in an axial direction thereof. A second-end-side body portion 18 whose outside diameter is smaller than that of the center body portion 19 is provided at a second end side of the center body portion 19. The second-end-side body portion 18 insulates a portion between the metal terminal 40 and the metal shell 50. A first-end-side body portion 17 whose outside diameter is smaller than that of the second-end-side body portion 18 is provided at a first end side of the center body portion 19. An insulator nose length portion 13 whose outside diameter is smaller than that of the first-end-side body portion 17 and becomes smaller towards a side of the center electrode 20 is provided closer to the first end side than the first-end-side body portion 17 is.

The metal shell 50 is a cylindrical metal shell that surrounds and holds a portion extending from part of the second-end-side body portion 18 of the insulator 10 to the insulator nose length portion 13. The metal shell 50 is made of, for example, low-carbon steel. The entire metal shell 50 is plated with, for example, nickel or zinc. The metal shell 50 includes a tool engaging portion 51, a sealing portion 54, and a mounting threaded portion 52 in that order from the second end side. A tool for mounting the spark plug 100 on an engine head is fitted to the tool engaging portion 51. The mounting threaded portion 52 has a thread that is screwed into a mounting threaded hole in the engine head. The sealing portion 54 is provided in the form of a flange on a root of the mounting threaded portion 52. An annular gasket 65, which is made from a bent plate material, is fitted to and inserted in a portion between the sealing portion 54 and the engine head. A first-end-side end surface 57 of the metal shell 50 is a hollow cylinder. One end of the insulator nose length portion 13 and one end of the center electrode 20 project from the center of the end surface 57.

A thin crimping portion 53 is provided closer to the second end side than the tool engaging portion 51 of the metal shell 50 is. A compression deformation portion 58 that is thin as with the crimping portion 53 is provided between the sealing portion 54 and the tool engaging portion 51. Ring members 66 and 67 are interposed between an inner peripheral surface of the metal shell 50 and an outer peripheral surface of the second-end-side body portion 18 of the insulator 10, from the tool engaging portion 51 to the crimping portion 53. A portion between the ring members 66 and 67 is filled up with talc-69 powder. When manufacturing the spark plug 100, the compression deformation portion 58 is compressed and deformed by pressing the crimping portion 53 towards the first end side such that the crimping portion 53 is inwardly bent. By compressing and deforming the compression deformation portion 58, the insulator 10 is pressed towards the first end side in the metal shell 50 via the ring members 66 and 67 and the talc 69. By the pressing, the talc 69 is compressed in a direction of the axial line O to increase the airtightness in the metal shell 50.

At an inner periphery of the metal shell 50, a glass stepped portion 15 that is positioned at the other end of the insulator nose length portion 13 is pressed against a metal shell inner stepped portion 56, which is provided at an inner periphery of the mounting threaded portion 52, via an annular plate packing 68. The plate packing 68 is a material that maintains the airtightness between the metal shell 50 and the insulator 10 and that prevents fuel gas from flowing out.

The center electrode 20 is a bar-shaped member in which a core material 22 whose thermal conductivity is higher than that of an electrode base material 21 is buried in the electrode base material 21. The electrode base material 21 is composed of a nickel alloy whose main component is nickel. The core material 22 is composed of copper or an alloy whose main component is copper. For example, a noble metal tip, which is made of an iridium alloy or the like, may be joined to a first end side of the center electrode 20.

A flange 23 that projects towards an outer peripheral side is provided near a second end portion of the center electrode 20. The flange 23 contacts, from the second end side, an axial hole inner stepped portion 14, which is formed at the axial hole 12, to position the center electrode 20 in the insulator 10. The second end portion of the center electrode 20 is electrically connected to the metal terminal 40 via a sealing body 64 and a ceramic resistor 63.

Figure 2:
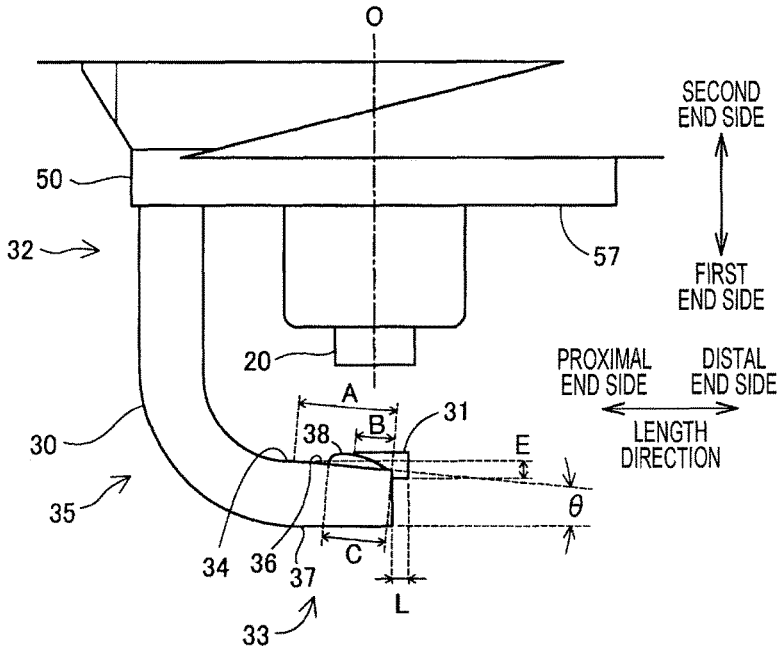
FIG. 2 is an enlarged side view of the vicinity of a ground electrode.

FIG. 2 is an enlarged side view of the vicinity of the ground electrode 30. In FIG. 2, a left-right direction in a plane that is perpendicular to the axial line O is called a "length direction" of the ground electrode 30. In addition, in FIG. 2, the right side in the plane is called a "distal end side" of the ground electrode 30 and the left side in the plane is called a "proximal end side" of the ground electrode 30. The ground electrode 30 is made of an alloy whose main component is nickel. The ground electrode 30 includes a proximal end portion 32 and a distal end portion 33. The proximal end portion 32 extends along the axial line O and is fixed to the first-end-side end surface 57 of the metal shell 50. In contrast, the distal end portion 33 extends in a direction that is perpendicular to the axial line O. An intermediate portion 35 is bent between the proximal end portion 32 and the distal end portion 33.

The distal end portion 33 of the ground electrode 30 includes a first surface 34 and a second surface 37. The first surface 34 is a surface that faces a side of the center electrode 20. The second surface 37 is a surface that faces a side that is opposite to the first surface 34. The thickness between the first surface 34 and the second surface 37 is, for example, 1.0 to 1.6 mm. In the present embodiment, the second surface 37 is perpendicular to the axial line O.

The distal end portion 33 of the ground electrode 30 has an inclined surface 36 at the side of the center electrode 20. The inclined surface 36 is a surface that is formed continuously with a distal end of the first surface 34 and is inclined with respect to the second surface 37 such that the thickness of the ground electrode 30 decreases towards the distal end side of the ground electrode 30. The inclined surface 36 is also inclined with respect to a direction that is perpendicular to the axial line O. In the present embodiment, the inclined surface 36 is a planar surface. An inclination angle θ of the inclined surface 36 with respect to the second surface 37 is, for example, greater than 0 degrees and less than or equal to 15 degrees. The inclined surface 36 is formed by pressing the distal end portion 33 of the ground electrode 30 prior to joining a noble metal tip 31 (described below) to the ground electrode 30.

The noble metal tip 31 is joined to the inclined surface 36. The noble metal tip 31 is made of, for example, a platinum alloy. In the present embodiment, the noble metal tip 31 has the shape of a rectangular column. The noble metal tip 31 is joined to the inclined surface 36 such that a length direction of the noble metal tip 31 is along the length direction of the ground electrode 30. In the embodiment, a surface of the noble metal tip 31 that is at the side of the center electrode 20 is perpendicular to the axial line O. The thickness of the noble metal tip 31, that is, the dimension of the noble metal tip 31 in a direction along the axial line is, for example, 0.5 to 1.0 mm. The noble metal tip 31 is joined to the ground electrode 30 by, for example, resistance welding. Obviously, the noble metal tip 31 may be joined to the ground electrode 30 by other joining methods, such as laser welding. A welded portion 38 is formed at a boundary between the noble metal tip 31 and the inclined surface 36. The welded portion 38 is a portion where the ground electrode 30 and the noble metal tip 31 are welded together. More specifically, the welded portion 38 is a portion where, when the noble metal tip 31 is to be welded to the ground electrode 30, the materials of the noble metal tip 31 and the ground electrode 30 are welded together and are thereafter solidified.

In the present embodiment, the noble metal tip 31 is joined to the ground electrode 30 such that a distal end of the noble metal tip 31 projects towards the distal end side from the distal end portion 33 of the ground electrode 30. A projection amount L of the noble metal tip 31 in a direction that is perpendicular to the axial line O is, for example, 0.5 to 3.0 mm. The noble metal tip 31 is joined to the inclined surface 36 such that part of the noble metal tip 31 is buried in the ground electrode 30.

Figure 3:
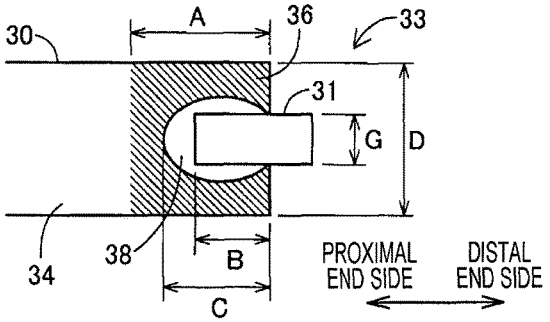
FIG. 3 is a top view of a distal end portion of the ground electrode when seen from a side of a center electrode.

FIG. 3 is a top view of the distal end portion 33 of the ground electrode 30 when seen from the side of the center electrode 20. In FIG. 3, for the sake of easier understanding, an inclined portion of the inclined surface 36 is hatched. In the present embodiment, the external shape of the inclined surface 36 is a rectangular shape. A width D of the inclined surface is larger than a width G of the noble metal tip 31. The width G of the noble metal tip 31 is, for example, 0.7 to 1.5 mm. The width D of the inclined surface is, for example, 2.0 to 3.0 mm.

In the present embodiment, the relationship between a distance A from a distal end of the ground electrode 30 to a proximal-end-side end portion of the inclined surface 36 and a distance B from the distal end of the ground electrode 30 to a proximal-end-side end portion of the noble metal tip 31 is A≥B. As shown in FIG. 2, the distances A and B are distances along the inclined surface 36. The distance A is, for example, 0.8 to 3.0 mm. The distance B is, for example, 0.5 to 1.0 mm.

In the spark plug 100 according to the present embodiment described above, the inclined surface 36 that is inclined such that the thickness of the ground electrode 30 decreases towards the distal end side of the ground electrode 30 is provided at a center-electrode-20 side of the distal end portion 33 of the ground electrode 30. Since the inclined surface 36 is inclined towards the distal end of the ground electrode 30, the hampering of the growth of a flame kernel, which is generated between the center electrode 20 and the noble metal tip 31, due to the existence of the ground electrode 30 can be suppressed. Therefore, flame quenching is suppressed, so that it possible to increase the ignitability. In particular, in the present embodiment, since the width G of the noble metal tip 31 is smaller than the width D of the inclined surface 36, and the distance A from the distal end of the ground electrode 30 to the inclined surface 36 is greater than or equal to the distance B from the distal end of the ground electrode 30 to the noble metal tip 31, a large actually inclined portion can be provided in the inclined surface 36. Therefore, flame quenching can be further reduced, so that it is possible to further effectively increase the ignitability.

In the present embodiment, it is desirable that the inclination angle θ (see FIG. 2) of the inclined surface 36 be greater than or equal to 1 degree. When the inclination angle θ is greater than or equal to 1 degree, it is possible to increase the ignitability than when the inclination angle θ is less than 1 degree.

In the present embodiment, it is desirable that the inclination angle θ of the inclined surface 36 be less than or equal to 6 degrees and a burying amount E (see FIG. 2) of the noble metal tip 31 with respect to the ground electrode 30 be greater than or equal to 0.2 mm. The burying amount E is the distance from the proximal-end-side end portion of the inclined surface 36 to a lower surface of the noble metal tip 31. When the inclination angle θ is less than or equal to 6 degrees and the burying amount E is greater than or equal to 0.2 mm, the welding strength of the noble metal tip 31 can be increased. Therefore, the falling off of the noble metal tip 31 is suppressed, so that it is possible to increase the durability of the spark plug 100.

In the present embodiment, when an area of a portion defined by excluding the welded portion 38 and the noble metal tip 31 from the inclined surface 36 (hatched portion in FIG. 3) is S, it is desirable that the relationship between the area S and the distance A and the width D be (A×D)/S≤4.

When the area S and the distance A and the width D satisfy such a relationship, the area of the actually inclined portion (hatched portion in FIG. 3) of the inclined surface 36 can be properly provided. Therefore, flame quenching is further suppressed, so that it is possible to increase the ignitability. In the description below, the expression "(A×D)/S≤4" is also called an "inclination area ratio". When the inclination area ratio is less than or equal to 4, the hatched portion exists in a range of ¼ or greater with respect to the product of the distance A and the width D.

In the present embodiment, it is desirable that the relationship between the distance A from the distal end of the ground electrode 30 to the proximal-end-side end portion of the inclined surface 36 and a distance C from the distal end of the ground electrode 30 to a proximal-end-side end portion of the welded portion 38 be A≥C. When the distance A is greater than or equal to the distance C, the area of the inclined surface 36 can be made large, so that it is possible to further increase the ignitability. The distance C is, for example, 0.7 to 2.0 mm. As with the distance A and the distance B, the distance C is a distance along the inclined surface 36.

Evaluation Test Results

Figure 4:
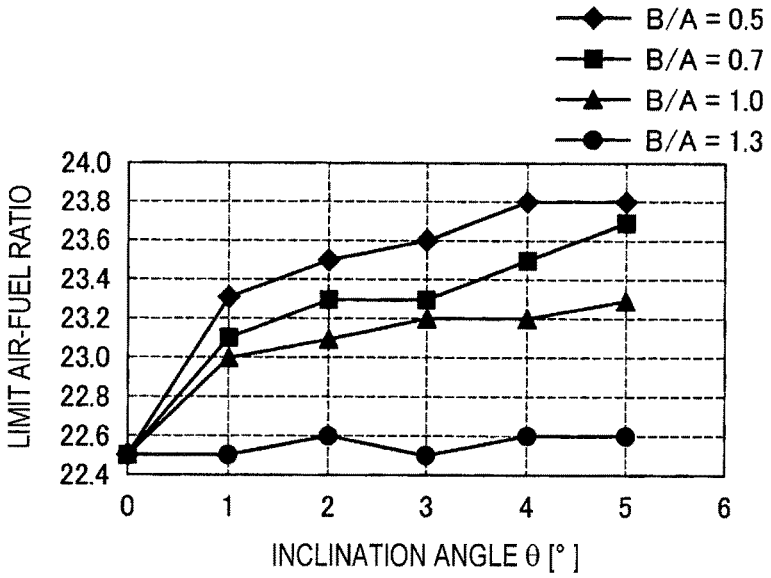
FIG. 4 is a graph of the results of a first test.

FIG. 4 is a graph of the results of a first test performed by evaluating the inclination angles θ of inclined surfaces 36. In this test, samples of spark plugs 100 in which the inclination angles θ of the inclined surfaces 36 and the ratios of the distances B with respect to the corresponding distances A differed were prepared, and the ignitability of each sample was evaluated. The specification of each sample is:

Distance B=0.8 mm,
Distance C=1.2 mm,
Width D=2.2 mm,
Burying amount E=0.3 mm,
Distance L=0.65 mm, and
Width G=0.7 mm.

In this test, each sample was mounted on a DOHC engine having a displacement of 1.5 L and being an in-line 4-cylinder engine. At 1600 rpm and an intake pressure of 340 kPa, evaluations were performed by measuring values of limit air/fuel ratios (A/F) for a 1% misfire per 1000 cycles. Each value of the limit air/fuel ratio in FIG. 4 is an average value obtained by performing tests on five samples having the same specification. The higher the limit air/fuel ratio value, the better the ignitability. In this test, it was determined that, when the limit air/fuel ratio value was greater than or equal to 23.0, the ignitability was good.

As shown in FIG. 4, it was confirmed that, when the ratio of the distance B with respect to the distance A (=B/A) was less than or equal to 1.0, that is, when the distance A and the distance B were the same, or the distance A was greater than the distance B; and when the inclination angle θ was greater than or equal to 1 degree, all of the samples had good ignitability than samples having an inclination angle of zero degrees, that is, samples not having the inclined surfaces 36. Therefore, in the above-described embodiment, it is desirable that the distance A be greater than or equal to the distance B, and that the inclination angle be greater than or equal to 1 degree.

Figure 5:
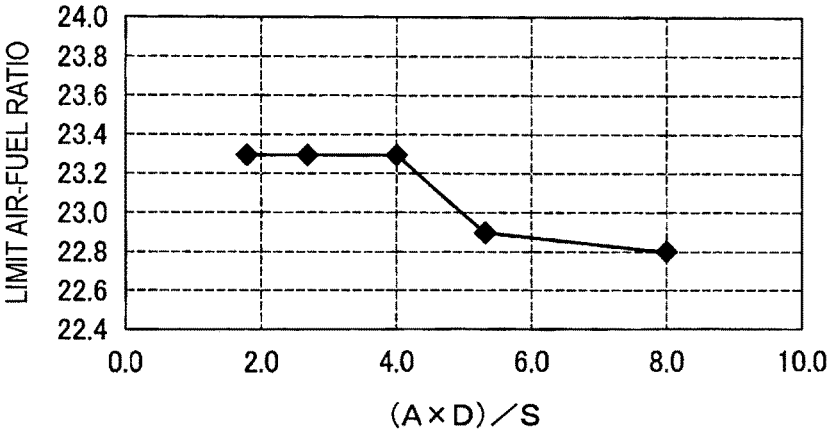
FIG. 5 is a graph of the results of a second test.

FIG. 5 is a graph of the results of a second test performed by evaluating the areas of inclined surfaces 36. In this test, samples of spark plugs 100 in which the inclination angle was 3 degrees, the distance C was 1.0 mm, and the values of the inclination area ratios ((A×D)/S) differed were prepared, and the ignitability of each sample was evaluated as in the first test. The specification of each sample excluding parameters included in the inclination angle θ, the distance C, and the inclination area ratio was the same as the specification in the above-described first test. Each value of the limit air/fuel ratio in FIG. 5 is an average value obtained by performing tests on five samples having the same specification.

As shown in FIG. 5, it was confirmed that, when the inclination area ratio was less than or equal to 4.0, the ignitability was increased compared to when the inclination area ratio was greater than 4.0. Therefore, in the above-described embodiment, it is desirable that the inclination area ratio be less than or equal to 4.0.

Figures 6, 7:
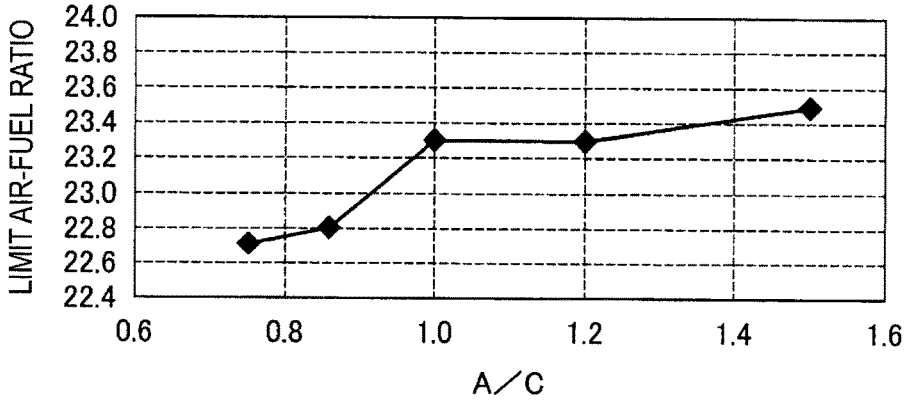
FIG. 6 shows the results of a third test.
FIG. 7 is a graph of the results of a fourth test.

FIG. 6 shows the results of a third test performed by evaluating anti-peeling performance of noble metal tips 31. In this test, samples of spark plugs 100 in which the burying amounts E of the noble metal tips 31 and the inclination angles θ of the inclined surfaces 36 differed were prepared, and the anti-peeling performance of each sample was evaluated. The specification of each sample is the same as the specification in the aforementioned first text except that the distance A is 1.2 mm. In this test, a desktop cooling test was performed, and the result was "pass" when the oxidized scale after the test was less than 50% and was "fail" when the oxidized scale after the test was greater than or equal to 50%. In the desktop cooling test, a joint surface of each noble metal tip 31 and the corresponding inclined surface 36 was heated for two minutes at a temperature of 1000° C. by a burner, and, then, a one-minute cooling cycle was performed 1000 times. Then, a half section of each joint surface was observed with a metallurgical microscope, and the lengths of cracks (gaps) in the joint surfaces were measured to determine the proportions of the oxidized scales with respect to the joint surfaces. The number of samples for each specification is five. It was determined that if there were any samples that failed the test, the specification thereof was evaluated as "fail".

As shown in FIG. 6, it was confirmed that when the inclination angle θ of the inclined surface 36 was less than or equal to 6 degrees and the burying amount E was greater than or equal to 0.2 mm, the oxidized scale was small and good anti-peeling performance was obtained. Therefore, in the above-described embodiment, it is desirable that the inclination angle θ be less than or equal to 6 degrees and the burying amount E be greater than or equal to 0.2 mm. In this test, even when the inclination angle θ was 8 degrees, a good result was obtained when the burying amount E was 0.4 mm.

FIG. 7 is a graph of the results of a fourth test performed by evaluating the relationships between the distances A and the corresponding distances C. In this test, samples having different distances C were prepared, and the ignitability was evaluated by the same test as the first test. Except that the inclination angle is 3 degrees and the distance A is 1.2, the specification of each sample is the same as that of the above-described first test. Each value of the limit air/fuel ratio is an average value obtained by performing tests on five samples having the same specification.

As shown in FIG. 7, it was confirmed that when the ratio (=A/C) of the distance A with respect to the distance C was greater than or equal to 1.0, that is, when the distance A was greater than or equal to the distance C, good ignitability was obtained. Therefore, in the above-described embodiment, it is desirable that the distance A be greater than or equal to the distance C.

Other Embodiments

Figure 8:
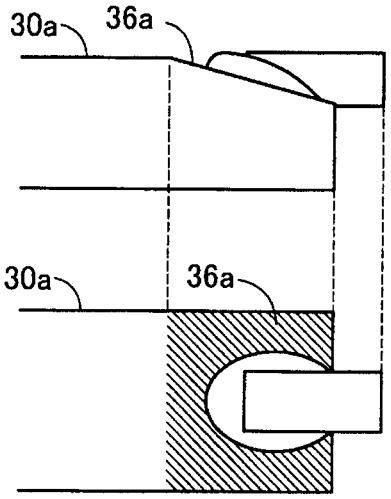
FIG. 8 shows a spark plug according to another embodiment.
Figure 9:
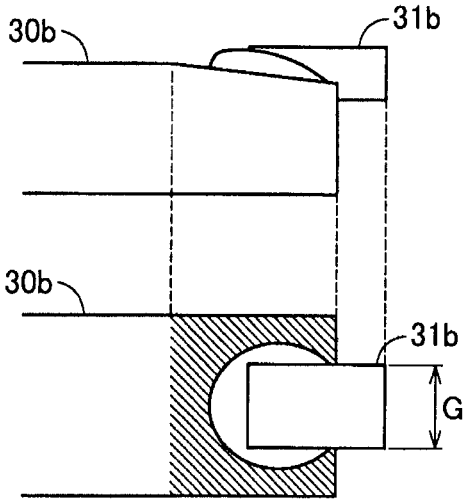
FIG. 9 shows a spark plug according to still another embodiment.
Figure 10:
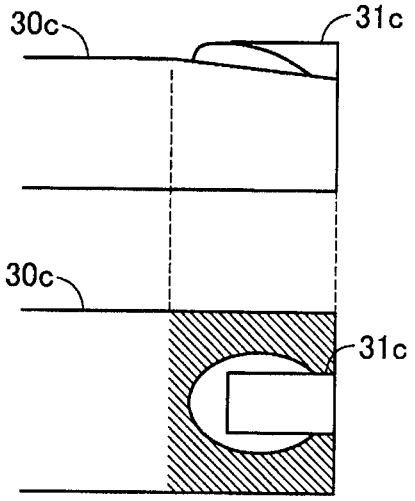
FIG. 10 shows a spark plug according to still another embodiment.
Figure 11:
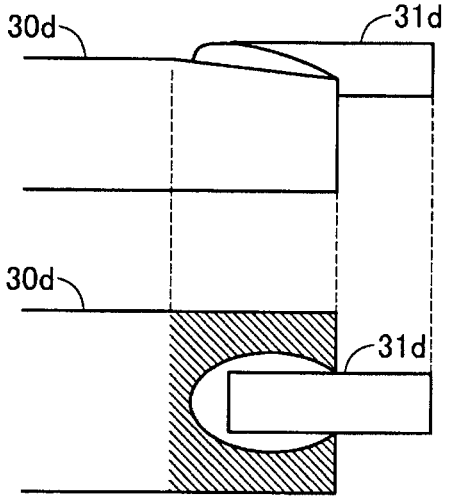
FIG. 11 shows a spark plug according to still another embodiment.

FIGS. 8 to 11 show spark plugs according to other embodiments. In each of these figures, an upper side corresponds to a side surface of a ground electrode, and a lower side corresponds to a top surface of the ground electrode. FIG. 8 shows a ground electrode 30*a* having an inclined surface 36*a* whose inclination angle is greater than that in the first embodiment. FIG. 9 shows a ground electrode 30*b* where a width G of a noble metal tip 31*b* is larger than that in the first embodiment. FIG. 10 shows a ground electrode 30*c* provided with a noble metal tip 31*c* that is shorter in length than that in the first embodiment. In the embodiment shown in FIG. 10, the position of a distal end of the noble metal tip 31*c* is aligned with the position of a distal end of the ground electrode 30*c*. FIG. 11 shows a ground electrode 30*d* provided with a noble metal tip 31*d* that is longer in length towards the distal end side than that in the first embodiment. As shown in these figures, the ground electrode 30 and the noble metal tip 31 may have various shapes.

MODIFICATIONS

First Modification

In the above-described embodiment, as long as the thickness of the inclined surface 36 decreases towards the distal end side of the ground electrode 30, the inclined surface 36 need not be a planar surface. For example, the inclined surface 36 may be a curved surface.

Second Modification

In the above-described embodiment, the external shape of the inclined surface 36 is a rectangular shape. However, the external shape of the inclined surface 36 may be other polygonal shapes, or part of or the entire inclined surface 36 may be curved.

Third Modification

In the above-described embodiment, the noble metal tip 31 has the shape of a rectangular column. However, the noble metal tip 31 may have other shapes. For example, the noble metal tip 31 may have a cylindrical shape. In addition, for example, a center-electrode-20-side surface of the noble metal tip 31 may be inclined with respect to a plane that is perpendicular to the axial line O.

Fourth Modification

In the above-described embodiment, the second surface 37 of the ground electrode 30 is perpendicular to the axial line O. However, the second surface 37 of the ground electrode 30 may be inclined with respect to the plane that is perpendicular to the axial line O.

Fifth Modification

In the above-described embodiment, the proximal end portion 32 of the ground electrode 30 extends along the axial line O. However, the proximal end portion 32 may extend in a direction that is oblique with respect to the axial line O. In addition, in the above-described embodiment, the distal end portion 33 of the ground electrode 30 extends along a direction that is perpendicular to the axial line O. However, the distal end portion 33 may extend along a direction that is oblique with respect to the direction that is perpendicular to the axial line.

Sixth Embodiment

The dimensions of each part in the above-described embodiments are examples. Various other dimensions are applicable.

The present invention is not limited to the above-described embodiments, examples, and modifications, so that various structures can be realized within a scope that does not depart from the gist of the present invention. For example, any of the technical features in the embodiments, examples, and modifications corresponding to the technical features in the aspect and forms described in the "Summary of Invention" section may be replaced with another or may be combined with another as appropriate for solving some or all of the aforementioned problems or for realizing some or all of the aforementioned advantages. If the technical features thereof are not described as being essential in the specification, they may be omitted as appropriate.

What is claimed is:

1. A spark plug comprising:

an insulator having an axial hole along an axial line;

a center electrode that is provided in the axial hole;

a cylindrical metal shell that is disposed around an outer periphery of the insulator; and a ground electrode having a base end and a distal end, said base end being fixed to the metal shell, wherein the ground electrode includes a distal end portion comprising;

a first surface that faces the center electrode, a second surface that faces a direction opposite to the first surface, an inclined surface that is formed continuously with a distal end of the first surface and is inclined with respect to the second surface such that a thickness of the ground electrode decreases towards a distal end side of the ground electrode, and a welded portion formed on the inclined surface, said welded portion having a protrusion that protrudes toward the center electrode, wherein a noble metal tip is joined to the inclined surface via the welded portion such that part of the noble metal tip is buried in the inclined surface, wherein a width of the inclined surface is larger than a width of the noble metal tip, and wherein $A \geq B$ is satisfied, where A is a distance from the distal end of the ground electrode to a proximal-end-side end portion of the inclined surface and B is a distance from the distal end of the ground electrode to a proximal-end-side end portion of the noble metal tip.

2. The spark plug according to claim 1, wherein the inclined surface is a planar surface, and wherein an inclination angle θ of the inclined surface with respect to the second surface is greater than or equal to 1 degree.

3. The spark plug according to claim 1, wherein the inclined surface is a planar surface, wherein an inclination angle θ of the inclined surface with respect to the second surface is less than or equal to 6 degrees, and wherein a burying amount E of the noble metal tip along the axial line from the proximal-end-side end portion of the inclined surface is greater than or equal to 0.2 mm.

4. The spark plug according to claim 1, wherein an external shape of the inclined surface is a rectangular shape, and wherein $(A \times D)/S \leq 4$ is satisfied, where D is a width of the inclined surface and S is an area of the inclined surface excluding the noble metal tip and the welded portion.

5. The spark plug according to claim 1, wherein $A \geq C$ is satisfied, where C is a distance from the distal end of the ground electrode to a proximal-end-side end portion of the welded portion.

6. The spark plug according to claim 1, wherein a distal end of the noble metal tip projects from the distal end of the ground electrode in a direction perpendicular to the axial line.

7. The spark plug according to claim 6, wherein a projection amount of the noble metal tip in the direction perpendicular to the axial line is 0.5 to 3.0 mm.

8. The spark plug according to claim 1, wherein the second surface extends in a direction perpendicular to the axial line.

9. The spark plug according to claim 6, wherein a protruding amount of the protrusion is greater in a proximal end side of the welded portion than a distal end side of the welded portion.

10. The spark plug according to claim 1, wherein a surface of the noble metal tip facing the center electrode is parallel with a surface of the center electrode facing the noble metal tip.

* * * * *